US005903799A

United States Patent [19]

Saito et al.

[11] Patent Number: 5,903,799

[45] **Date of Patent: *May 11, 1999**

[54] IMAGE HEATING APPARATUS WITH ENERGIZATION CONTROL

[75] Inventors: Rie Saito, Yokohama; Jiro Ishizuka, Chiba, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/654,581

[22] Filed: May 29, 1996

[30] Foreign Application Priority Data

May 31, 1995 [JP] Japan ..... 7-155560

[51] Int. Cl.[6] ..... G03G 15/20

[52] U.S. Cl. ..... 399/69; 219/216

[58] Field of Search ..... 355/282, 285, 355/289, 290; 219/216; 399/69, 328, 330, 43

[56] References Cited

U.S. PATENT DOCUMENTS 4,878,092 10/1989 Arai ..... 355/285
5,179,263 1/1993 Koh et al. ..... 219/216
5,444,521 8/1995 Tomoyuki et al. ..... 355/285
5,464,964 11/1995 Okuda et al. ..... 219/216 X
5,534,987 7/1996 Ohtsuka et al. ..... 355/285

FOREIGN PATENT DOCUMENTS 59-068769 4/1984 Japan .
59-146075 8/1984 Japan .
60-213977 10/1985 Japan .
63-216083 9/1988 Japan .

*Primary Examiner*—Robert Beatty
*Attorney, Agent, or Firm*—Fitzpatrick, Cella, Harper & Scinto

[57] ABSTRACT

An image heating apparatus has a heater for generating heat by energization, a heat member heated by the heater, a temperature detector for detecting a temperature of the heat member, and an energization control for controlling the energization of the heater in such a manner that the temperature detected by the temperature detector is maintained at a target temperature. When the temperature of the heat member is detected to reach a lowermost point during a contiuous copy operation, the energization control reduces power.

7 Claims, 7 Drawing Sheets

IMAGE HEATING APPARATUS WITH ENERGIZATION CONTROL

BACKGROUND OF THE INVENTION

1. Field of the Invention

The present invention relates to an image heating apparatus used with a copying machine, a printer and the like, and more particularly, it relates to an image heating apparatus suitable for color copying machines, color printers and the like.

2. Related Background Art

In fixing devices used with an electrophotographic image forming apparatus such as a copying machine, a laser beam printer and the like, a recording material to which a toner image was transferred is pinched between a pair of rollers so that the image is permanently fixed to the recording material with heat and pressure. Surfaces of the rollers used in such fixing devices are coated by material having good mold releasing ability, heat-resistance and anti-wear, such as fluororesin, silicone rubber or the like.

Particularly, in color copying machines having a purpose for providing good image quality, there is a tendency for using a fixing roller having a surface on which silicone rubber is coated. Further, in full-color copying machines, in order to obtain a multi-color image, different color toner images are formed on a recording material. In this case, during a fixing operation, since the toner images must be fully fused and mixed, unlike to mono-color copying machines in which each of rollers is constituted by coating a thin fluororesin layer on a metal core, rollers having substantial thickness and softness and called as "soft rollers" having large heat capacity must be used so that the toner can be heated and fused in a confined manner.

The toner used in this case must have good fusibility and mixing ability upon application of heat, and, thus, sharp-melt toner having low softening point and low fusing viscosity is usually used. However, when the above-mentioned features are used in the fixing device, there arises a problem regarding "overshoot temperatures" of the fixing roller and the pressure roller.

Now, factors for generation the overshoot and disadvantages caused by the overshoot will be explained. First of all, when such rollers having large layer thickness are used as the fixing roller and the pressure roller, the time for transmitting the heat from a heater disposed a center of the roller to the outer surface of the roller is increased. After the heater is turned ON by detecting the fact that the temperature of the roller surface is low by means of a temperature detecting element contacted with the roller surface, it takes a very long time to increase the temperature of the roller surface to a desired value by the transmission of the heat from the heater. In an image forming apparatus in which a process speed is slow and a sheet interval i.e. sheet-to-sheet distance (between adjacent recording materials) is long, as shown by the symbol "A" in FIG. 6, since the temperature of the roller surface is restored during the recording material sheet interval, it is not required that the temperature adjust temperature is set to a high value.

However, in a high speed image forming apparatus, as shown by the symbol "B" in FIG. 6, before the heat of the heater is transmitted to the roller surface, the temperature of the roller surface continues to be decreased. Thus, as shown, it is necessary to set the temperature adjust temperature (temperature at the initiation of the fixing operation) to a high value, such as 190° C. That is to say, if the temperature adjust temperature of "B" is set to 165° C as is in the "A", the temperature of the roller surface reaches a fixing lower limit temperature soon, with the result that the fixing operation cannot be effected.

Next, in observing the change in temperature when the copies continue to be obtained, as shown in FIG. 7, the temperature of the roller surface continues to be decreased until the temperature of the heater is transmitted to the roller surface. At that point (shown by (i)), the temperature of the roller surface is gradually restored due to the heat of the heater. In this case, since the temperature adjust temperature is 190° C, as shown, the heater is tuned ON repeatedly until the temperature of the roller surface reaches 190° C. Thus, if a large number of copies are obtained continuously, as shown, the temperature of the roller surface may be restored to the start temperature (temperature adjust temperature).

However, if the copying operation is stopped in the course of the gradual temperature increase (for example, at a point (ii)), a further recording material does not pass through a nip between the fixing roller and the pressure roller. As a result, since the heat on the roller surface is not absorbed by the recording material and the radiation of heat is not enhanced due to the stoppage of the rollers, the temperature of the roller surface is abruptly increased as shown by the symbol "$a_2$" (or "a") in FIG. 7. This is the overshoot. The amount of the overshoot is varied with the heat accumulating ability (heat accumulating amount) of the metal core and cover rubber layer of each roller and of any element(s) contacted with the roller(s) because the heater is repeatedly turned ON till the point (ii). In general, in the case where the rubber layer is made of the same material, the thicker the rubber layer, the greater the heat accumulating amount. Accordingly, in the above-mentioned color copying machines and color printers, since the rubber layer has great thickness, the amount of the overshoot becomes great.

The symbol "A" shown in FIG. 7 indicates the change in temperature of the roller surface during the first continuous copying operation after the copying machine is powered, and the symbol "B" shown in FIG. 7 indicates the change in temperature of the roller surface during the continuous copying operation started from a highest temperature point of the first overshoot. Regarding the "B", although the time duration between ON and OFF of the heater is shorter than that in the "A", the heat accumulating amount and the fixing lower limit temperature become greater than those in the "A", with the result that the amount of the overshoot becomes greater than that in the "A". If the continuous copying operation started from the highest temperature point of the second overshoot, the amount of the overshoot will be further increased.

Since the heat resisting ability of the silicon rubber used with the fixing roller is about 200° C. to 230° C. in the continuous operation, if such great overshoot occurs, the silicon rubber layer will be damaged. Further, the most undesired deterioration of image quality will occur. That is to say, not only if the temperature of the roller surface is too low, the cold offset will occur to cause the deterioration of image quality due to toner peel, but also if the temperature of the roller surface is too high, the sharp melt toner becomes hard to be separated from the heated rollers to cause the toner peel (called as "hot offset"), thereby deteriorating the image quality. And, the offset toner is gradually accumulated on the roller(s), thereby decreasing the service life of the roller(s).

SUMMARY OF THE INVENTION

The present invention aims to eliminate the above-mentioned conventional drawbacks, and an object of the present invention is to provide an image heating apparatus which can minimize overshoot of a heated member after a copying operation is stopped.

Another object of the present invention is to provide an image heating apparatus comprising a heater for generating heat by energization, a heated member heated by the heater, a temperature detection means for detecting a temperature of the heated member, an energization control means for controlling the energization of the heater in such a manner that the temperature detected by the temperature detection means is maintained to a target temperature, and a temperature decrease stop detection means for detecting temperature decrease stop of the heated member when a plurality of recording materials are continuously heated. The energization control means decreases energization power, after the temperature decrease stop to a value smaller than that before the temperature decrease stop.

The other objects and features of the present invention will be apparent from the following detailed description of the invention referring to the accompanying drawings.

DETAILED DESCRIPTION OF THE PREFERRED EMBODIMENTS (First Embodiment)

First of all, a first embodiment of the present invention will be explained with reference to FIGS. 1 to 5.

Figure 3:
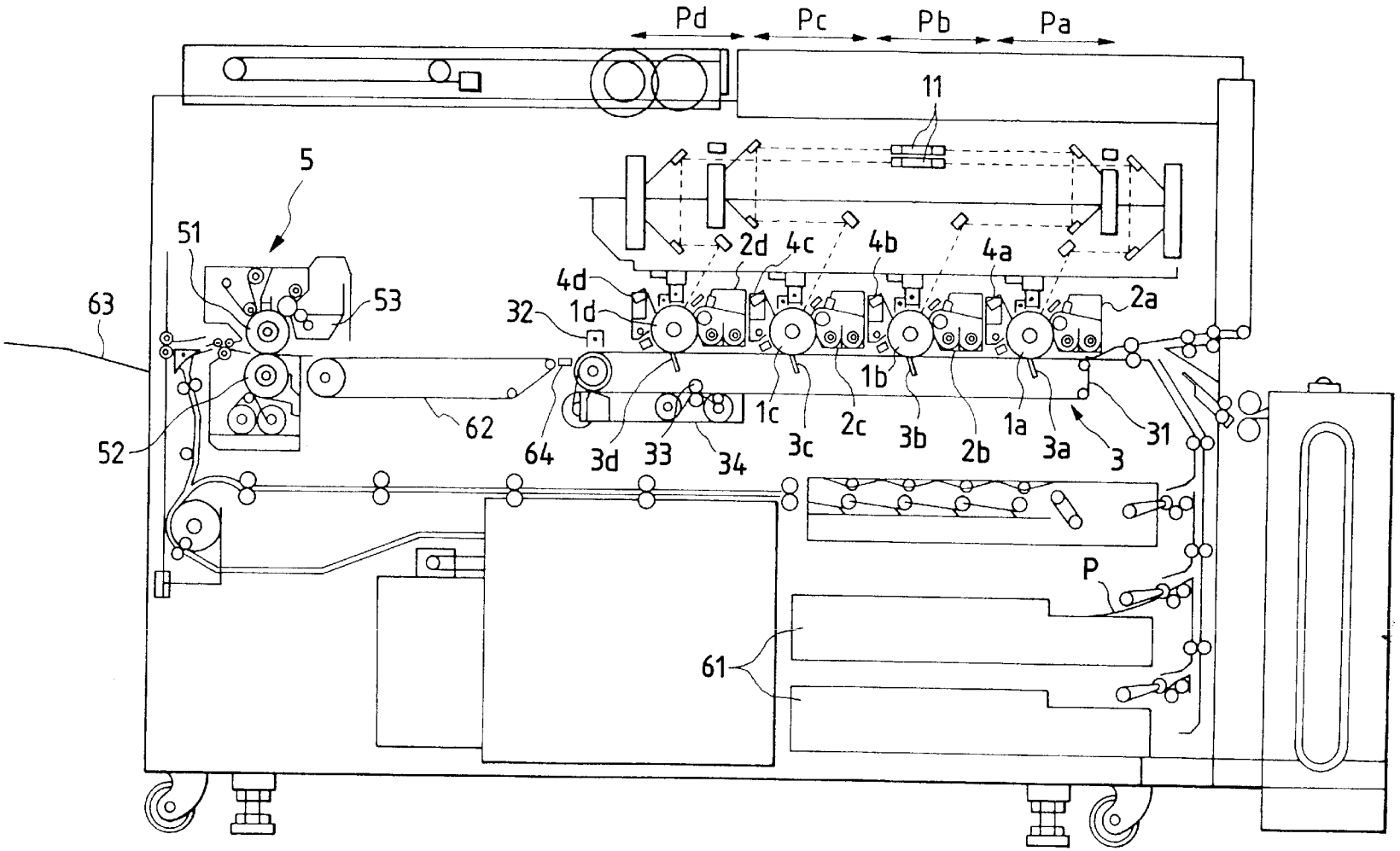
FIG. 3 is a schematic elevational sectional view of an image forming apparatus according to the first embodiment.
Figure 4:
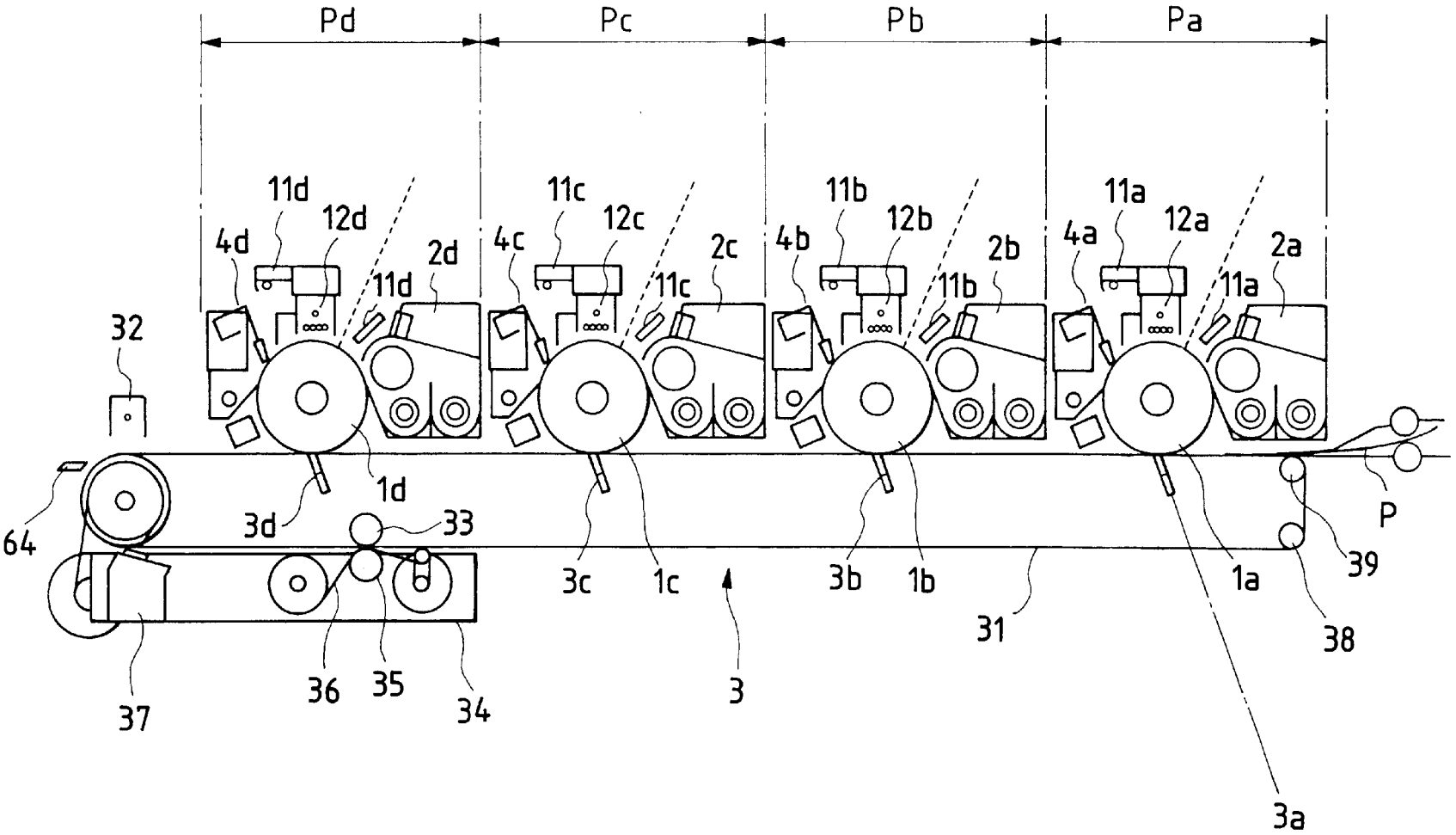
FIG. 4 is an enlarged sectional view of an image forming portion of the apparatus of FIG. 3.

FIGS. 3 and 4 show a four-drum type laser beam printer having a plurality of light scanning means as an example of an image forming apparatus according to the first embodiment of the present invention. As shown in FIG. 3, there are provided four image forming stations (image forming means) each including an electrophotographic photosensitive member or image bearing member (referred to as "photosensitive drum" hereinafter) around which a developing device and the like are disposed. The images formed on the photosensitive drums in the respective image forming stations are successively transferred onto a recording material (referred to as "transfer sheet" hereinafter) P supported on a convey means moving along the photosensitive drums.

More particularly, as shown in FIG. 4, the image forming stations P*a*, P*b*, P*c* and P*d* for forming magenta, cyan, yellow and black toner images, respectively, include the photosensitive drums 1*a*, 1*b*, 1*c* and 1*d* which are rotated in clockwise directions shown by the arrows. Further, around the photosensitive drums 1*a* to 1*d*, there are disposed chargers 12*a*, 12*b*, 12*c* and 12*d*, developing devices 2*a*, 2*b*, 2*c* and 2*d*, and cleaners 4*a*, 4*b*, 4*c* and 4*d*, which elements 12*a* to 12*d*, 2*a* to 2*d* and 4*a* to 4*d* are successively arranged along the rotational directions of the photosensitive drums. Below the photosensitive drums, there are disposed a transfer portion 3 which includes transfer chargers 3*a*, 3*b*, 3*c* and 3*d* associated with the corresponding photosensitive drums, and a transfer belt (recording material convey means) 31 common to all of the photosensitive drums.

In the printer having the above-mentioned construction, a transfer sheet P supplied from either of sheet supply cassettes (recording material supply means) 61 is conveyed to the transfer belt 31 and supported thereby so that the transfer sheet is passed through the image forming stations successively. Meanwhile, the different color toner images formed on the photosensitive drums are successively transferred onto the transfer sheet P. After the transferring operations are completed, the transfer sheet P is separated from the transfer belt 31. The separated transfer sheet is conveyed to a fixing device (image heating device) 5 through a convey belt (recording material guide means) 62.

Figure 5:
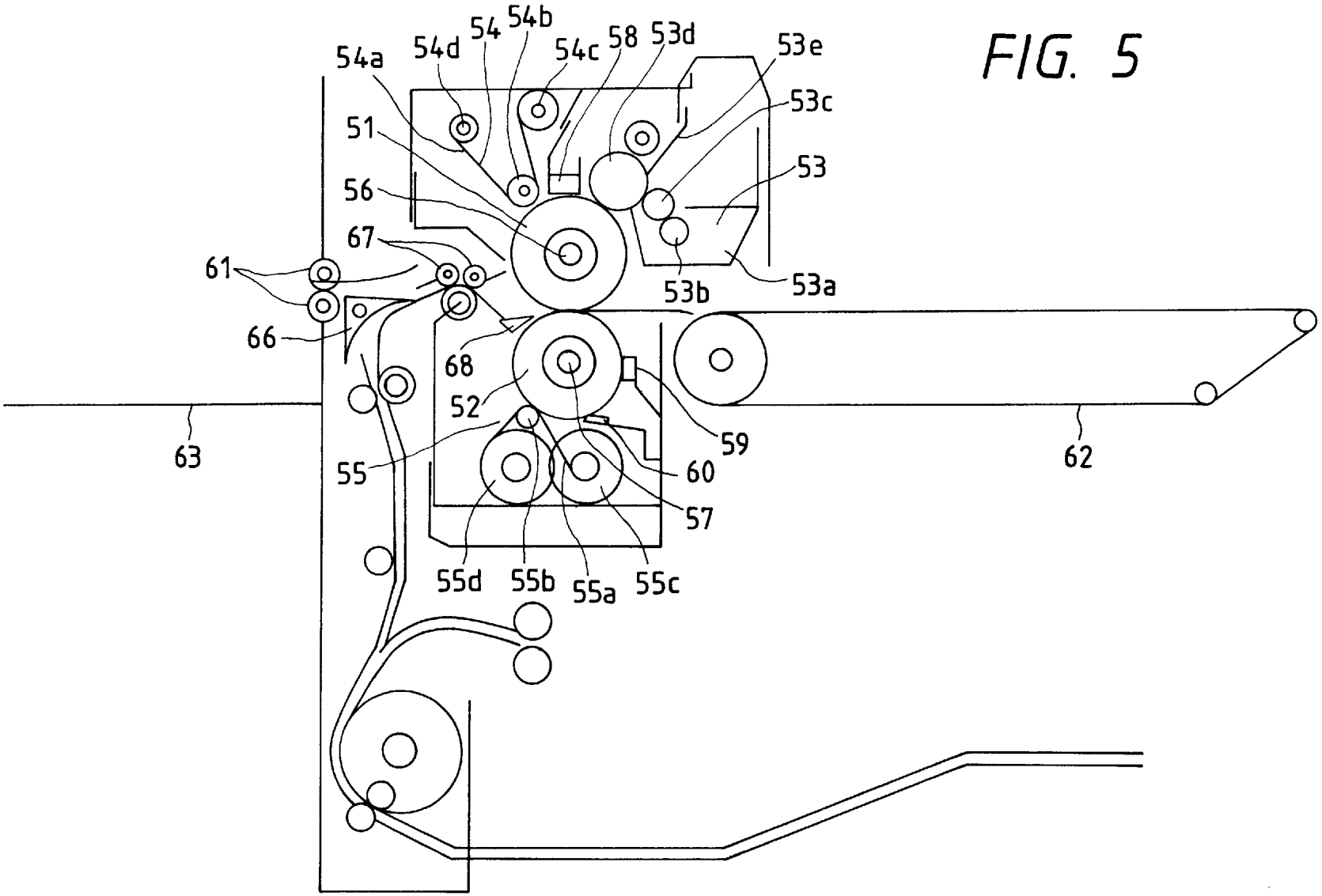
FIG. 5 is an enlarged view of a fixing device of the apparatus of FIG. 3.
Figure 6:
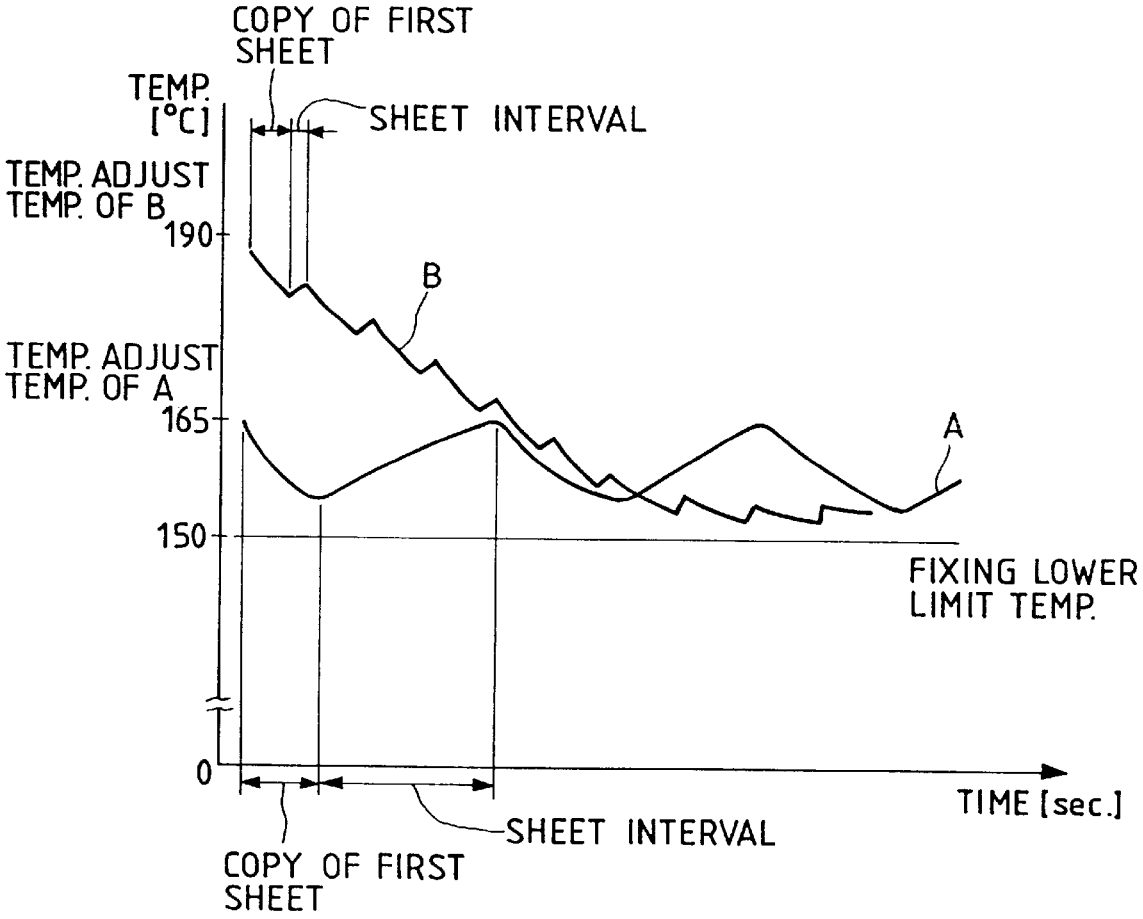
FIG. 6 PRIOR ART
FIGS. 6 and 7 are graphs showing change in temperature of a roller surface under conventional control.
Figure 7:
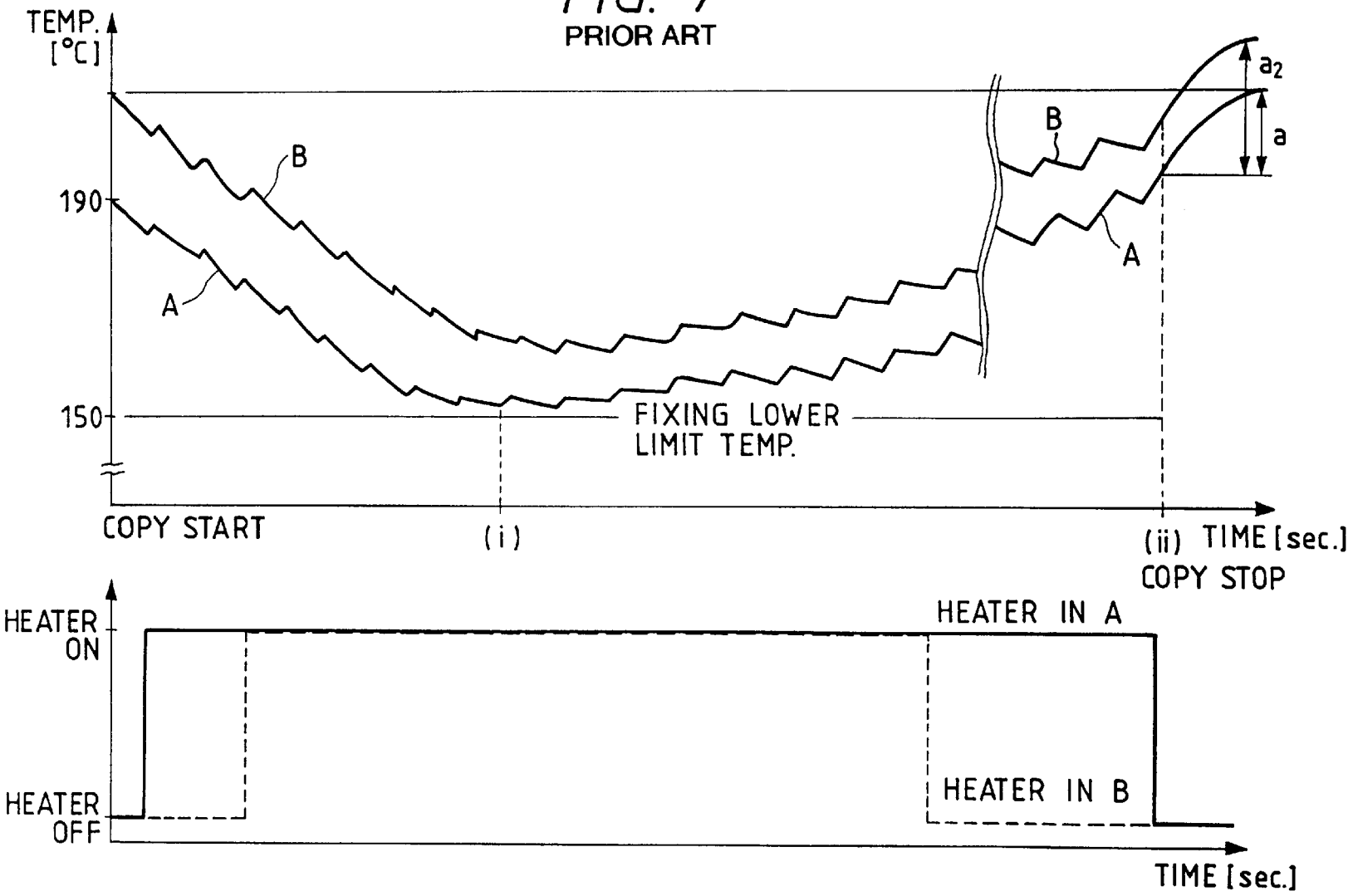
FIG. 7 PRIOR ART

As fully shown in FIG. 5, the fixing device 5 comprises a rotatable fixing roller (first heat member) 51, a pressure roller (second heat member) 53 urged against the fixing roller while being rotated, a mold releasing agent coating device (mold releasing agent supplying and coating means) 53, and roller cleaning devices 54, 55. The fixing roller 51 and the pressure roller 52 include therein halogen heaters (heat means) 56 and 57, respectively. Further, thermistors (temperature detection means) 58 and 59 are contacted with the fixing roller 51 and the pressure roller 52, respectively so that temperatures of surfaces of the pressure roller 52 are adjusted by controlling voltages applied to the heaters 56, 57 by means of a temperature adjustment circuit (energization control means) (not shown) on the basis of the detection results from the thermistors. The energization control means controls the energization of the heater 56 so that the temperature detected by the thermistor 58 is maintained to a target temperature and also controls the energization of the heater 57 so that the temperature detected by the thermistor 59 is maintained to a target temperature.

The cleaning device 54 and the mold releasing agent coating device 53 are associated with the fixing roller 51, and the toner and the like offset onto the fixing roller 51 is removed by the cleaning device 54. Further, silicone oil (mold releasing agent) is coated on the fixing roller 51 by the mold releasing agent coating device 53, thereby facilitating the separation of the transfer sheet P from the fixing roller 51 and preventing the toner offset onto the fixing roller 51.

The cleaning device 54 includes a cleaning web 54*a* formed from a heat-resistance non-woven fabric strip, an urging roller 54*b* for urging the cleaning web 54*a* against the fixing roller 51, a supply roller 54*c* for supplying a new portion of the cleaning web 54*a*, and a take-up roller 54*d* for gradually collecting a waste portion (having poor cleaning ability) of the cleaning web 54*a*. Particularly, in order to prevent the offset toner from adhering the thermistor 58 so that the detecting ability of the thermistor 58 is well maintained, the cleaning device 54 is disposed at an upstream side of the thermistor 58 in a rotational direction of the fixing roller 51.

The mold releasing agent coating device 53 comprises an oil tank 53*a* containing silicone oil therein, pick-up rollers 53*b*, 53*c* for picking up the silicone oil from the oil tank 53*a*, a coating roller 53*d* for coating or supplying the silicone oil from the pick-up rollers 53*c*, 53*d* onto the fixing roller 51, and a blade 53*e* for controlling a coating oil amount of the coating roller 53*d*. Particularly, in order to uniformly coat the oil onto the fixing roller 51, the mold releasing agent coating device 53 is disposed at a downstream side of the thermistor 58 in the rotational direction of the fixing roller 51. Incidentally, the coating roller 53*d* comprises a rotatable roller formed from a sponge roller on which a silicone rubber layer is coated, which roller can be contacted with the fixing roller 51 on demand to apply the oil to the fixing roller 51.

The cleaning device 55 is associated with the pressure roller 52. Similar to the cleaning device 54, the cleaning device 55 includes a cleaning web 55*a*, an urging roller 55*b*, a supply roller 55*c* and a take-up roller 55*d* so that the toner adhered to the pressure roller 52 via the fixing roller 51 can be removed by the cleaning device 55.

Further, an oil removing blade 60 for removing the residual mold releasing agent remaining on the pressure roller 52 is urged against the pressure roller 52. If there is no oil removal blade 60, excessive mold releasing agent will be trapped in the nip between the fixing roller 51 and the pressure roller 52, with the result that the oil is transferred onto the transfer sheet P to smudge it (or, when the transfer sheet is an OHP transparent laminate film slid occurs between the oil and the film to prevent the smooth penetration of the film into the nip, thereby causing the poor fixing). The oil removing blade 60 is made of material such as Si rubber, fluororubber or the like and is urged against the pressure roller 52 with appropriate penetrating amount and with inclination with respect to the pressure roller.

In this condition, when the transfer sheet approaches the fixing device, the fixing roller 51 and the pressure roller 52 are rotated at constant speeds and the silicone oil is coated on the surface of the fixing roller 51. While the transfer sheet is being passed through the nip between the fixing roller 51 and the pressure roller 52, the transfer sheet is uniformly heated and pressurized from both sides so that the non-fixed toner images on the transfer sheet are fused and mixed, thereby forming a full-color image on the transfer sheet P. The transfer sheet P to which the full-color image was fixed is separated from the pressure roller 52 by a lower separation pawl 68, and the separated transfer sheet is discharged out of the printer.

In the image forming apparatus having the above-mentioned construction, since the occurrence of the overshoot must be suppressed after the last transfer sheet leaves the nip between the fixing roller 51 and the pressure roller 52, in the illustrated embodiment, the following temperature control is performed.

Figure 1:
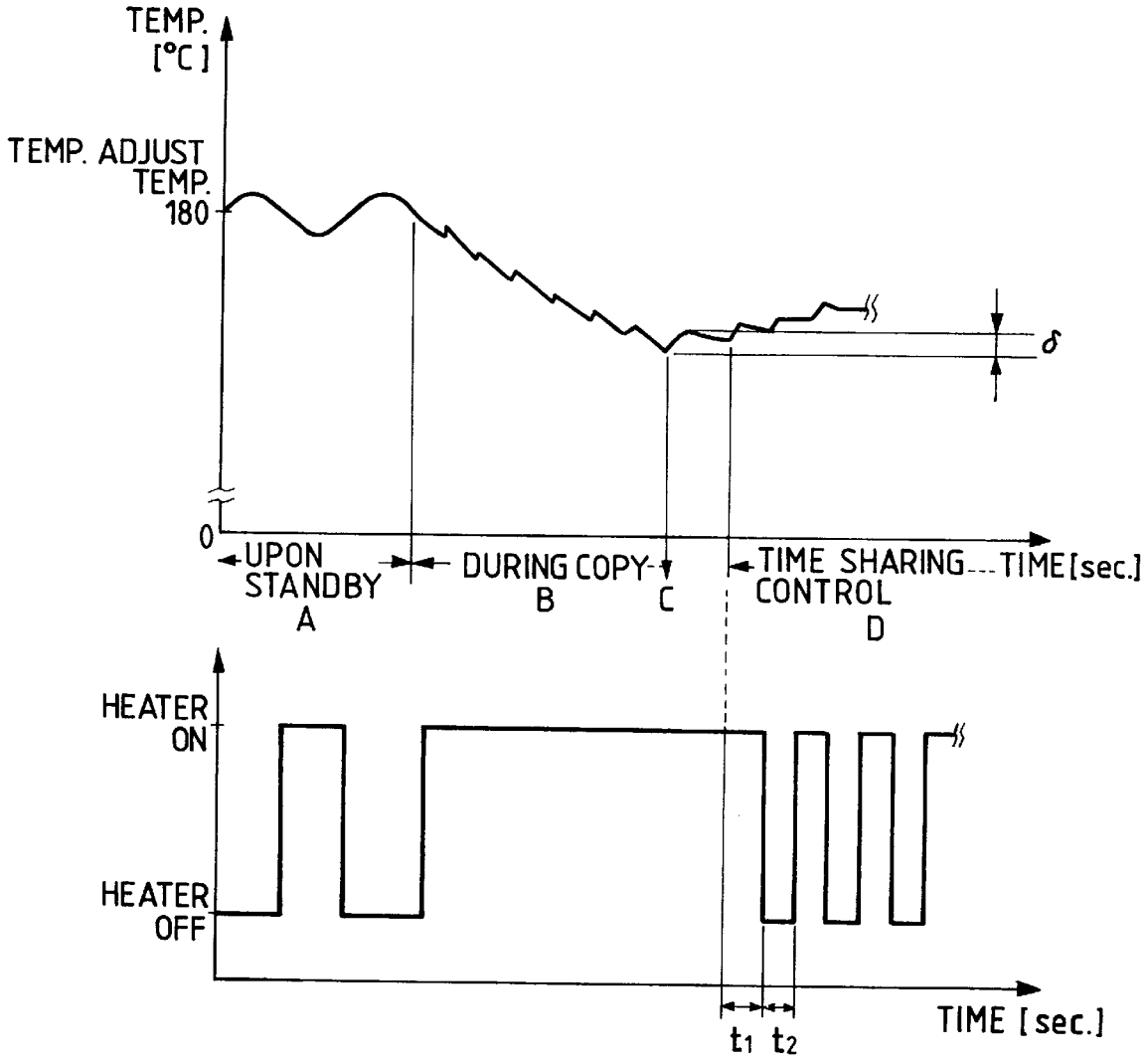
FIG. 1 is a heater control timing chart, and a graph showing change in temperature of a roller surface under control, according to a first embodiment of the present invention.

FIG. 1 shows a heater control timing chart, and a graph showing change in temperature of a roller surface under control, according to the first embodiment of the present invention. According to this embodiment, in a warming-up condition and a stand-by condition of the printer, the temperatures of the roller surfaces are detected by the thermistors 58, 59 (FIG. 5). If the detected temperature is higher than the temperature adjust temperature, the heater is turned OFF, and when the detected temperature decreased below the temperature adjust temperature, the heater is turned ON. By repeating OFF/ON of the heater, the temperature control is effected. As a result, in a zone (stand-by condition) shown by the symbol "A" in FIG. 1, the temperature of the roller surface is maintained within a predetermined range. From this condition, when the copying operation is started, since the temperature of the roller surface is gradually decreased in a zone (during copy) shown by the symbol "B" in FIG. 1, the heater continues to be turned ON in this zone. Since the heater continues to be turned ON, the temperature of the roller surface is gradually increased to reach a temperature increase zone shown by the symbol "D" in FIG. 1. In this temperature increase zone D, if the heater continues to be turned ON, since the overshoot is increased as mentioned above, according to the illustrated embodiment, time sharing control as shown in FIG. 1 is performed.

That is to say, as shown in FIG. 1, the heater is turned ON during a time period $t_1$ and then the heater is turned OFF during a time period $t_2$. By repeating this cycle, since the energization duty to the heater becomes half of the energization duty when the heater continues to be turned ON (in case of $t_1$,=$t_2$), the overshoot after the copying operation can be decreased. In fact, it was found that the overshoot of the roller when the heater continues to be turned ON is 20° C. whereas, the overshoot when the energization duty is half is 13° C.

In the illustrated embodiment, the time sharing control is started when it is judged that the temperature increase period is started by detecting a lowermost temperature point C by means of a temperature decrease stop detection means, and, in this judgement, it is judged whether the temperature increment reaches δ° C. as shown in FIG. 1. In the illustrated embodiment, the control was effected as δ=1. Since minor temperature increment smaller than 1° C. may occur in the temperature decrease period B due to the temperature restoring during the sheet interval (no sheet in the nip), by selecting δ=1, the minor temperature increment is excluded. Incidentally, the reference value δ may be appropriately selected on the basis of the construction of the fixing device and the like.

Figure 2:
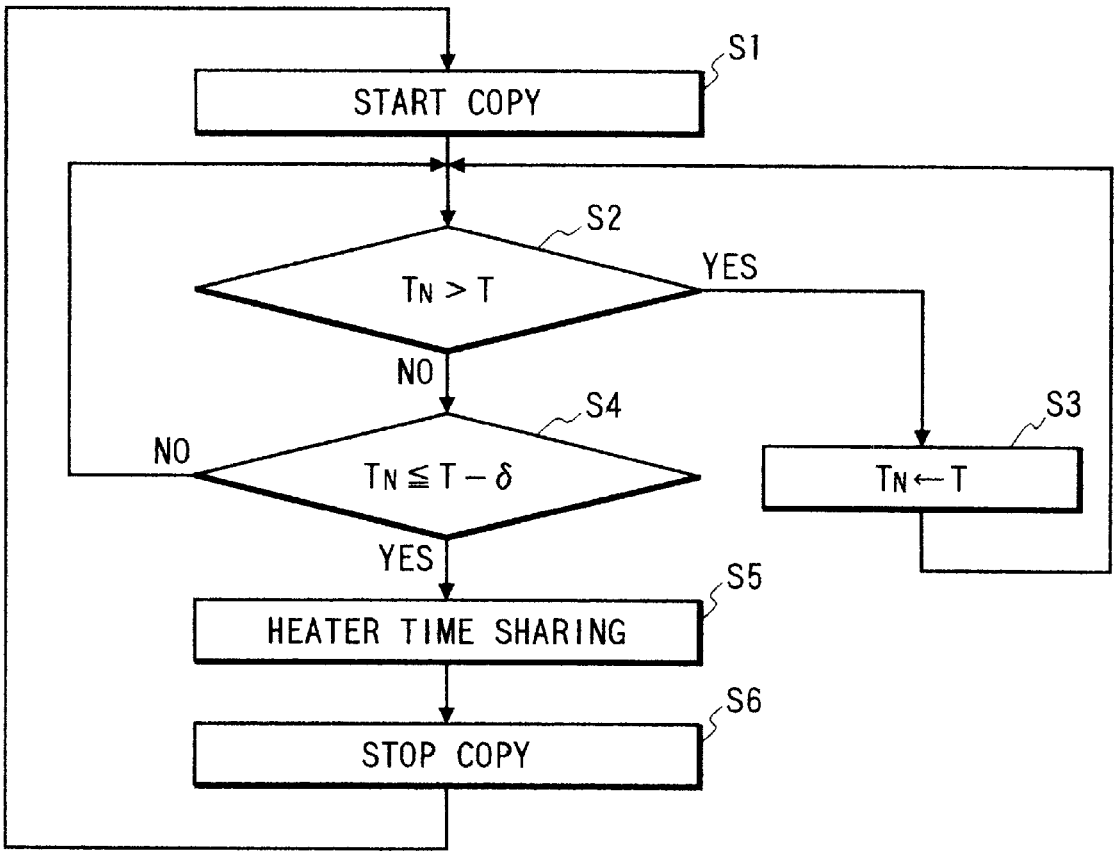
FIG. 2 is a flow chart for controlling a heater, according to the first embodiment.

Algorithm of sequence according to this embodiment is shown in FIG. 2. In this embodiment, a memory capable of storing the value of the thermistor 58 is prepared. When the copy is started (step S1), the present value T is compared with the content stored in the memory (i.e. previous value $T_N$) (step S2). If $T_N$>T, the content $T_N$ of the memory is successively rewritten to the present value T (step S3). When $T_N \leqq T$ is reached, the rewriting of the content of the memory is stopped, and, it is judged whether $T_N \leqq (T-\delta)$ (step S4). When $T_N \leqq (T-\delta)$ is reached, the time sharing control shown in FIG. 1 is started (step S5), and the time sharing control is continued till the copy stop (step S6).

As mentioned above, according to the illustrated embodiment, the overshoot can be reduced. Further, according to the control of the illustrated embodiment, since the ON duty of the heater is decreased after the lowermost temperature point of the temperature of the roller surface is detected, the lowermost temperature point of the temperature of the roller surface is not decreased smaller than the conventional cases.

(Second Embodiment)

Next, a second embodiment of the present invention will be explained. Incidentally, the same elements as those in the first embodiment are designated by the same reference numerals and explanation thereof will be omitted.

In this second embodiment, the control after the detection of the lowermost temperature point differs from that of the first embodiment. That is to say, in the first embodiment, although the time sharing control in which, after the lowermost temperature point is detected, the heater is turned ON for $t_1$ time and then the heater is turned OFF for $t_2$ time was effected, in the second embodiment, the effective wattage of the heater is controlled.

While the heater is being turned ON continuously, when half-wave control is effected regarding the heater of 800 W (for example), the effective wattage becomes 400 W. Accordingly, by effecting the half-wave control after the detection of the lowermost temperature point (temperature decrease stop point), the overshoot can be reduced as is in the first embodiment. This method is particularly effective when the allowable wattage during copy is small or when it is desired to reduce the power consumption.

Further, as another method for achieving the same advantage, a technique in which the upper and lower heaters are alternately energized can be used. Recently, in accordance with the increase in requirements for full-color both-face copies, since both of the fixing roller and the pressure roller are formed from the soft rollers in many cases, it is also necessary to consider the overshoot of the pressure roller. Thus, not that the fixing roller and the pressure roller are merely controlled at random, but that the fixing roller is turned ON while the pressure roller is being turned OFF, or vice versa. In this way, the power consumption can be minimized. In this case, the ON (energization) duty may be changed in dependence upon the thickness of the rollers. For example, when the fixing roller (upper roller) has the rubber layer of 2 mm and the pressure roller (lower roller) has the rubber layer of 1 mm and the upper and lower heaters have the same output, by controlling the heater ON time at 2:1, more effective temperature control can be achieved.

(Third Embodiment)

Next, a third embodiment of the present invention will be explained. Incidentally, the same elements as those in the first embodiment are designated by the same reference numerals and explanation thereof will be omitted.

In this third embodiment, the temperature is adjusted by appropriately changing the temperature increment δ after the detection of the lowermost temperature point, ON/OFF duty of the heater, i.e. $t_1$:$t_2$. Recently, in color copying machines, it has been required that an image can be copied on various materials and the good image quality can be maintained. When various material having different thicknesses are passed through the fixing device, heat amount removed from the rollers is varied with the kind of materials, and the fixing permitting temperature and speed are also varied with the kind of materials.

In the mono-color copying machines using this layer (hard) rollers, the temperature adjust temperature is changed in accordance with the kind of material. As mentioned above, in the color copying machines using the soft rollers, since it takes a long time to increase and decrease the temperature, normally, the temperature adjust temperature is set to a constant value, and the temperature is adjusted by changing the rotational speed of the roller and the sheet-to-sheet (cpm).

Accordingly, the restoring temperature during the sheet interval and the time reaching the lowermost temperature point are varied with the kind of material. In consideration of the above, in this third embodiment, the values δ, $t_1$ and $t_2$ regarding various kinds of materials are independently stored in the memory, and, in accordance with the selected material (transfer sheet), the control is changed as is in the first embodiment. In this way, more effective control can be achieved. Alternatively, not that the values δ, $t_1$ and $t_2$ regarding various kinds of materials are independently stored in the memory, but that the values δ, $t_1$ and $t_2$ regarding the rotational speed of the roller and the sheet interval (cpm) may be independently stored in the memory and, in accordance with the selected rotational speed of the roller and/or the sheet interval (cpm), the control may be changed as is in the first embodiment.

Alternatively, since the temperature of the roller is varied with the environmental temperature, the values δ, $t_1$ and $t_2$ regarding various temperatures may be independently stored in the memory and a temperature sensor may be provided in the printer and, in accordance with the detected temperature from the sensor, the control may be changed. Alternatively, in both-face copying machines, since the change in temperature of the roller in the one-face copy mode differs from that in the both-face copy mode, the values δ, $t_1$ and $t_2$ regarding the one-face copy mode and the both-face copy mode may be independently stored in the memory and, in accordance with the copy mode, the control may be changed.

The present invention is not limited to the above-mentioned embodiments, but various alterations and modifications can be effected within the scope of the invention.

What is claimed is:

1. An image heating apparatus comprising:

a heater generating heat by energization;

a heat member to be heated by said heater;

a temperature detection means for detecting a temperature of said heat member;

an energization control means for controlling energization power to said heater such that the temperature of said heat member detected by said temperature detection means is maintained at a target temperature, a temperature of a surface of said heat member being gradually decreased and thereafter increased while said heat member is continuously heating a plurality of recording materials; and judge means for judging whether the temperature of said heat member has reached a lowermost point while it is continuously heating the plurality of recording materials when an increase of the temperature of said heat member is larger than a predetermined value, wherein, when the temperature of said heat member reaches the lowermost point, said energization control means reduces the energization power to said heater to a level lower than it was before the detected temperature reached to the lowermost point.

2. An image heating apparatus according to claim 1, wherein said energization control means time-sharing controls energization of power to said heater after the temperature of said heat member reaches the lowermost point.

3. An image heating apparatus, comprising:

a heater to be heated by energization;

a heat member to be heated by said heater;

a temperature detection means for detecting a temperature of said heat member;

an energization control means for controlling an energization power to said heater so that the temperature of said heat member detected by said temperature detection means is maintained at a target temperature, a temperature of a surface of said heat member being gradually decreased and thereafter increased while said heat member is continuously heating a plurality of recording materials; and compare means for comparing a difference between a first detected temperature and a second detected temperature detected by said detection means to determine if it has reached a predetermined value, wherein when the difference reaches the predetermined value in continuing to heat the plurality of recording materials, said control means makes the energization power smaller before heating of the last recording material is finished.

4. An image heating apparatus according to claim 3, the predetermined value is variable in accordance with kinds of the recording materials.

5. An image heating apparatus according to claim 3, the predetermined value is variable in accordance with conveying interval when the plurality of recording materials is conveyed continuously.

6. An image heating apparatus according to claim 3, said heat member have a roller shape, and the predetermined value is variable in accordance with the rotation speed of said heat member.

7. An image heating apparatus according to claim 3, said apparatus is used for a printer for both of one-sided copy and two-sided copy, and the predetermined value differs between one-sided copy and two-sided copy.

* * * * *

UNITED STATES PATENT AND TRADEMARK OFFICE

CERTIFICATE OF CORRECTION

PATENT NO. : 5,903,799

DATED : May 11, 1999

INVENTOR(S) : RIE SAITO, ET AL.

It is certified that error appears in the above-identified patent and that said Letters Patent is hereby corrected as shown below:

COVER PAGE AT ITEM [57] ABSTRACT,
Line 9, "contiuous" should read --continuous--.
COLUMN 2,
Line 11, "tuned" should read --turned--; and
Line 29, "till" should read --until--.
COLUMN 6,
Line 5, "$t_1$,=$t_2$)," should read --$t_1$=$t_2$),--.
COLUMN 8,
Line 63, "claim 3," should read --claim 3, wherein--; and
Line 66, "claim 3," should read --claim 3, wherein--.
COLUMN 9,
Line 3, "claim 3," should read --claim 3, wherein--; and
Line 4, "have" should read --has--.
COLUMN 10,
Line 1, "claim 3," should read --claim 3, wherein--.

Signed and Sealed this

Ninth Day of November, 1999

*Attest:*

*Attesting Officer*

Q. TODD DICKINSON

*Acting Commissioner of Patents and Trademarks*